US005511680A

United States Patent [19]

Kinne

[11] Patent Number: 5,511,680

[45] Date of Patent: Apr. 30, 1996

[54] TEAR-AWAY CANISTER LID

[75] Inventor: Daniel J. Kinne, Cincinnati, Ohio

[73] Assignee: The Procter and Gamble Company, Cincinnati, Ohio

[21] Appl. No.: 383,559

[22] Filed: Feb. 2, 1995

Related U.S. Application Data

[63] Continuation of Ser. No. 116,434, Sep. 3, 1993, abandoned.

[51] Int. Cl.[6] ..... B65D 17/40

[52] U.S. Cl. ..... 206/276; 220/306; 220/307

[58] Field of Search ..... 220/306, 307, 220/359, 257, 276

[56] References Cited

U.S. PATENT DOCUMENTS

| | | | |
|---|---|---|---|
| 3,494,500 | 2/1970 | Foster | 220/54 |
| 3,773,207 | 11/1973 | Dokoupil et al. | 220/27 |
| 3,858,748 | 1/1975 | Marco | 220/276 |
| 4,113,136 | 9/1978 | Abbott | 220/276 |
| 4,146,148 | 3/1979 | Dwinell et al. | 220/270 |
| 4,171,062 | 10/1979 | Allen et al. | 220/270 |
| 4,207,989 | 6/1980 | Ingemann | 220/266 |
| 4,209,107 | 6/1980 | Crisci | 220/306 |
| 4,212,409 | 7/1980 | Jeppsson | 220/276 |
| 4,215,797 | 8/1980 | Chen | 220/359 |
| 4,332,332 | 6/1982 | Ingemann | 220/276 |
| 4,380,304 | 4/1983 | Anderson | 220/307 |
| 4,433,793 | 2/1984 | Ingemann | 220/276 |
| 4,434,907 | 3/1984 | Ingemann | 220/276 |
| 4,453,647 | 6/1984 | Neat | 220/288 |
| 4,529,100 | 7/1985 | Ingemann | 220/359 |
| 4,711,364 | 12/1987 | Letica | 220/276 |
| 4,732,293 | 3/1988 | Landis | 220/306 |
| 4,738,374 | 4/1988 | Ingemann | 220/258 |
| 4,787,530 | 11/1988 | Edwards | 220/266 |
| 4,795,055 | 1/1989 | Ingemann | 220/270 |
| 4,834,259 | 5/1989 | Kubis et al. | 220/266 |
| 4,934,554 | 6/1990 | Edwards | 220/266 |
| 4,946,063 | 8/1990 | Heyes et al. | 220/276 |
| 5,002,223 | 3/1991 | Bolte et al. | 220/276 |
| 5,007,231 | 4/1991 | Ingemann | 53/412 |
| 5,054,642 | 10/1991 | Yoshida | 220/276 |
| 5,114,068 | 5/1992 | Reil et al. | 229/123.2 |
| 5,215,207 | 6/1993 | Stolzman | 220/359 |
| 5,284,265 | 2/1994 | Crisci | 220/276 |

FOREIGN PATENT DOCUMENTS

| | | | |
|---|---|---|---|
| WO85/04382 | 10/1985 | European Pat. Off. . | |
| 2617756 | 1/1989 | France . | |
| 3810799 | 10/1989 | Germany . | |
| 3148446 | 6/1991 | Japan | 220/276 |
| 4154565 | 5/1992 | Japan | 220/359 |
| 2010788 | 7/1979 | United Kingdom . | |
| 2252093 | 7/1992 | United Kingdom . | |

*Primary Examiner*—David T. Fidei
*Attorney, Agent, or Firm*—Michael E. Hilton; Daniel F. Nesbitt

[57] ABSTRACT

The present invention pertains to improved closure arrangements which are durable in construction, yet easy to open and reclose, and which provide an initial hermetic seal with tamper evidency, all utilizing a one-piece lid design. In two embodiments according to the present invention, unique combinations of a mechanical interlocking closure system, heat-sealing or bonding, and a weakened failure zone are employed in the vicinity of the lid/container juncture to achieve these desirable characteristics. In a third embodiment of the present invention, a mechanical interlocking and sealing arrangement is utilized to achieve hermetic sealing of the container without the need for a heat seal or bonded region, and a weakened failure zone is located just inward of the mechanical interlocking connection. With all embodiments according to the present invention, upon tearing the lid open the lid forms a recloseable plug-fit closure to reclose the container, while the rim of the lid once remains attached to the container in its initial position. The resulting container is extraordinarily simple in construction, rendering it easy and cost effective to produce, yet providing superior performance both in maintaining the initial freshness of the product and in providing ease of consumer operation.

18 Claims, 3 Drawing Sheets

TEAR-AWAY CANISTER LID

This is a continuation of application Ser. No. 08/116,434, filed on Sep. 3, 1993, now abandoned.

FIELD OF THE INVENTION

The present invention pertains to improved closure designs for recloseable and resealable canisters or containers for perishable products. More particularly, the present invention pertains to closure arrangements which combine an initial hermetic seal to ensure product freshness, a mechanical interlocking lid rim-to-container coupling for structural integrity, and a frangible zone to separate the lid rim from the recloseable and resealable lid and provide tamper evidency, all in a one-piece lid design.

BACKGROUND OF THE INVENTION

Many products in use today are perishable, at least to a degree, in that their performance may degrade over time when they are exposed to atmospheric air, moisture, or other contamination prior to use. Products which are volatile may have components which evaporate or dissipate, moist products may dry out, and dry products may become damp or soggy.

Containers (or canisters) for these perishable products must have lids and/or closures which ensure the freshness of the products prior to the initial use, even if they are subject to extended periods of storage after manufacture. Such closures must also be able to survive the rigors of transportation and handling, yet be easy to open by the consumer. Particularly when the product involved is a food product, the closure design also preferably includes some tamper-evidency feature to assure the consumer that the product is in its original, edible condition at the time of purchase.

An area of particular interest is the pre-mixed, ready-to-use food product area, especially in the ready-to-use frosting arena. These frosting products are used for icing on cakes and similar baked goods, and are ready to apply to the baked item directly from the container.

With products of this type, one of the main criteria in selecting a suitable container is the ability of the container (particularly in its initial unopened configuration) to resist the migration of moisture out of the product. Moisture loss results in drying out of the product, increasing its viscosity and decreasing its suitability for the intended application. Other products may be more sensitive to migration of gases into or out of the container.

As used herein, the term "hermetic" is intended to refer to seals between container components (namely the lid and container body) which provide at least a degree of resistance to moisture migration out of the container, preferably at least equal to that of the container and lid materials. Such seals may also provide resistance to migration of gases at least equal to that of the container body and lid materials. A seal of such quality would not be detrimental to the performance of the container inasmuch as the performance of the container would be limited by the choice of materials utilized for the lid and container and not by the design of or method of forming the seal employed.

One family of commercially available container designs utilizes a conventional plastic snap-on overcap with a foil inner seal over the mouth of the canister-like package. The inner seal provides a hermetic, tamper-evident initial seal which is protected during shipping by the plastic overcap.

Once the inner seal is removed, the plastic overcap can be used to reclose and reseal the container to protect the unused portion of the product until the next use.

These container designs require the use of a double-closure design (inner seal with overcap), thus increasing the quantity of material employed and the additional manufacturing steps to apply both closures sequentially. It is also frequently difficult to bond the foil inner seal to the mouth of the container strongly enough to provide the desired seal properties without making removal of the seal too difficult for consumers. The result is a narrow window of acceptable seal bond strength which balances these competing interests in a consumer-friendly package.

Another family of commercially available container designs utilizes a single closure which is heat-sealed or bonded to the mouth of the container. The closure is then peeled away from the mouth of the container for access to the product, and in a multi-use context the closure is usually insertable into the mouth of the container to provide for a recloseable seal of the container. Visual observation of tamper evidency is often difficult with this type of container design, and frequently the only detectable evidence of tampering is greater-than-normal ease of opening due to the lack of having to peel away the lid.

These container designs rely upon the heat seal or bonded region to provide both the initial hermetic seal and the structural seal to protect the contents during shipping and storage. These container designs still require the balancing of the removal force required to peel the lid free and the strength of the seal for structural purposes. It is possible for rough handling of such a container to subject the heat seal or bonded region to excessive localized stresses which may cause a failure of the hermetic seal, resulting in product spoilage prior to consumer purchase.

Still another family of commercially available container designs utilizes a single closure which is heat-sealed or bonded to the mouth of the container, and which utilizes a weakened area around the closure inboard of the bonded region to provide for severability of the main portion of the closure for access to the product. In a multi-use context, the closure then is insertable into the mouth of the container to provide for a recloseable seal of the container. Tamper evidency is provided by visual observation of the tearing of the weakened area upon opening of the container.

These container designs rely upon the heat seal or bonded region to provide both the initial hermetic seal and the structural seal to protect the contents during shipping and storage. While these designs do not required the heat seal to be of the peelable variety, it is still possible for rough handling of such a container to subject the heat seal or bonded region to excessive localized stresses which may cause a failure of the hermetic seal, resulting in product spoil age prior to consumer purchase.

Yet another family of commercially available container designs employs a mechanical closure system to provide a resealable closure system. These container designs frequently lack the ability to provide for an initial hermetic seal as required for perishable (particularly food) products, and many provide either tamper evidency or recloseability (but few provide both). Many of these container designs are also difficult for the consumer to open due to comparatively higher force requirements to disengage interlocking portions of the container which provide the hermetic initial seal.

Accordingly, it would be desirable to provide a container design which employs a recloseable, resealable closure system with a one-piece lid which provides for an initial hermetic seal with tamper evidence yet has sufficient structural integrity to survive rough treatment during transportation and handling while remaining easy to open.

SUMMARY OF THE INVENTION

The present invention provides improved lid and container configurations which are durable in construction, yet easy to open and reclose, and which provide an initial hermetic seal with tamper evidency, all utilizing a one-piece lid design.

In two embodiments according to the present invention, unique combinations of a mechanical interlocking closure system, heat-sealing or bonding, and a weakened failure zone are employed in the vicinity of the lid/container juncture to achieve these desirable characteristics. A third embodiment utilizes a unique mechanical interlocking arrangement, which eliminates the need for a heat seal or bond, and a weakened failure zone (or failure line) to achieve these characteristics.

In a first embodiment of the present invention, the mechanical interlocking connection is located at the periphery of the lid/container interface, with the heat seal or bonded region just inward of the interlocking connection. A weakened failure zone is located just inward of the hermetic seal or bond, and upon tearing the lid open the lid forms a recloseable plug-fit closure to reclose the container, while the rim of the lid remains attached to the container in its initial position.

In a second embodiment of the present invention, the heat seal or bonded region is located at the periphery of the lid/container interface, with the mechanical interlocking connection just inward of the heat seal or bonded region. A weakened failure zone is located just inward of the mechanical interlocking connection, and upon tearing the lid open the lid forms a recloseable plug-fit closure to reclose the container, while the rim of the lid once again remains attached to the container in its initial position.

In a third embodiment of the present invention, a mechanical interlocking and sealing arrangement is utilized to achieve hermetic sealing of the container without the need for a heat seal or bonded region. A weakened failure zone is located just inward of the mechanical interlocking connection, and upon tearing the lid open the lid forms a recloseable plug-fit closure to reclose the container, while the rim of the lid once again remains attached to the container in its initial position.

The resulting container is extraordinarily simple in construction, rendering it easy and cost effective to produce, yet providing superior performance both in maintaining the initial freshness of the product and in providing ease of consumer operation.

BRIEF DESCRIPTION OF THE DRAWINGS

The present invention will be better understood with reference to the following Detailed Description and to the accompanying Drawing Figures, in which.

With respect to all Drawing Figures, unless otherwise noted like elements are identified with like numerals for simplicity and clarity.

DETAILED DESCRIPTION OF THE INVENTION

Figure 1:
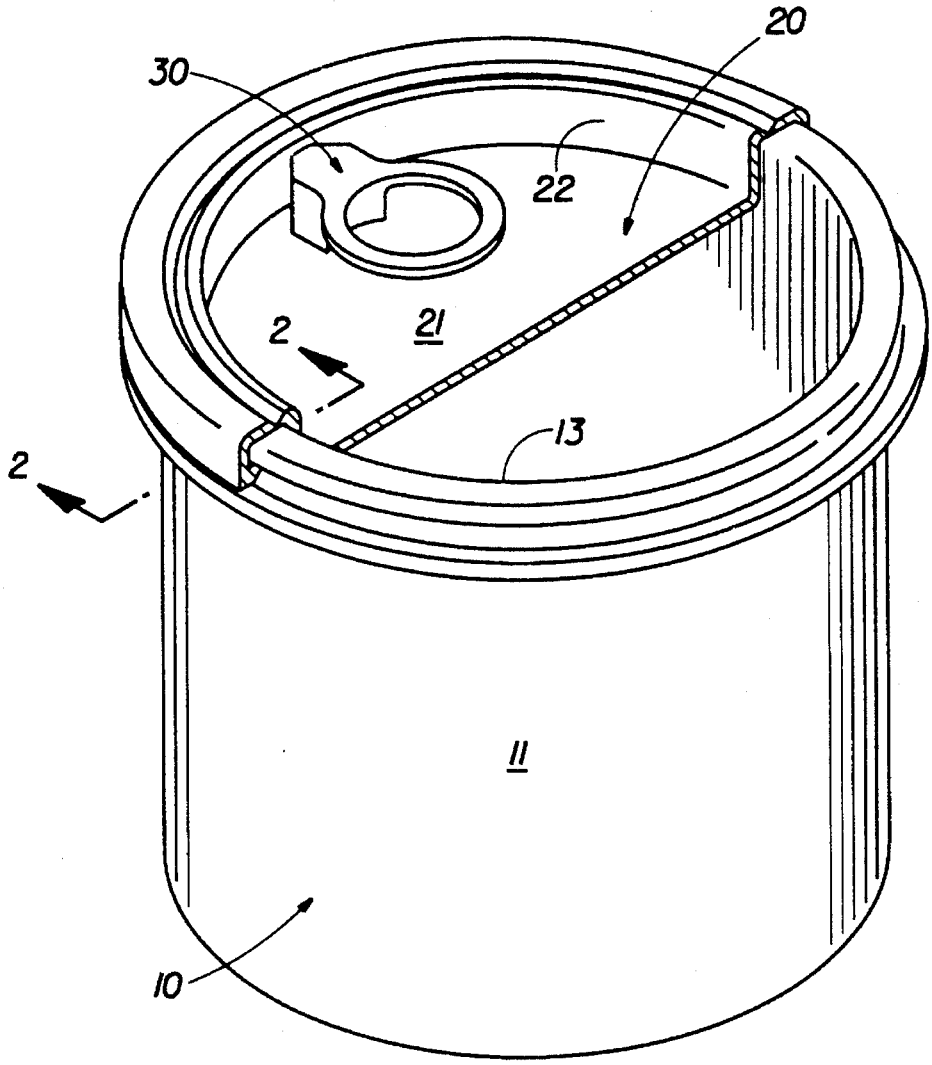
FIG. 1 is a perspective view of a container design according to a first embodiment of the present invention, with the closure partially sectioned to depict the relationship of the lid to the container.

FIG. 1 shows a container according to a first embodiment of the present invention, including a container body 10 with a lid 20 installed and partially broken away to illustrate more clearly the relationship of the container body 10 and lid 20 in the vicinity of their connection.

The main portion of the container body 10 is of the tub or canister variety as is generally well known in the art, having a sidewall 11, a bottom wall, and a mouth 13 having a generally annular configuration located at the uppermost edge of the sidewall 11. The lid 20 includes a center portion (or cover) 21 and a side portion (or inner wall) 22 for engaging the container sidewall 11 in the vicinity of the mouth 13. Also included as part of lid 20 is a pull tab 30, which is preferably of the finger loop variety as shown and is preferably unitarily molded as part of the lid 20.

Figure 2:
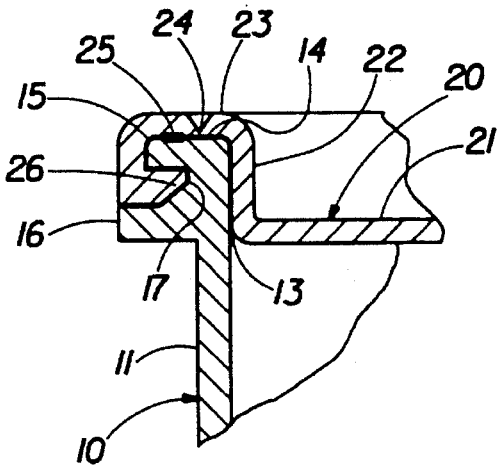
FIG. 2 is a fragmentary elevational sectional view taken along line 2—2 of FIG. 1, illustrating with greater clarity the interrelationship of the container and closure system.

FIG. 2, which is a fragmentary elevational sectional view of the container assembly of FIG. 1 taken along line 2—2, depicts in greater detail the relationship of the engaging portions of the lid 20 and the container body 10 in accordance with the present invention.

As shown in FIG. 2, the container body 10 further includes a flange 14 which is preferably generally planar in nature, an upper rim 15, a lower rim 16, and a locking groove 17 between the upper rim 15 and the lower rim 16, the significance of which will be discussed below. The lid 20 further includes a peripheral flange portion (or top annular wall) 23 extending outwardly of side portion 22 and configured so as to be engageable with container flange 14, a failure zone 24 extending circumferentially around the flange portion 23 so as to be located over the flange 14, a seal region 25 extending circumferentially around the flange portion 23, and a radially inwardly extending locking rib 26 configured so as to engage the locking groove 17 of container 10.

The central portion of the lid 20 located inward of the failure zone 24 is severable from the peripheral portion of the lid 20 located outward of the failure zone 24 in response to an upward pulling force exerted on pull tab 30 (as will be described with respect to FIGS. 4 and 5). The central portion of the lid 20 thus formed constitutes a recloseable plug-fit closure which may be re-inserted into the mouth 13 of the container following the initial opening operation. The weakened failure zone 24 may be of any desired shape, but a generally V-shaped groove profile is presently preferred as it tends to concentrate the opening force on the smallest possible area at the bottom of the groove where the lid material is thinnest.

The contacting portions of the lid 20 and the container body 10 are preferably dimensioned so as to provide an interference fit throughout their contact area, at least from the locking groove 17/locking rib 26 location to the lowest extent of the mouth 13/side portion 22 contact area. The interference fit between the mouth 13 and the side portion 22 provides for the hermetic seal properties of the container system in the reclosure scenario after initial opening of the container. The flange portion 23 inward of failure zone 24 is preferably of sufficient size so as to prevent the entire lid inward of the failure zone 24 from being pushed downward within the container body 10 during the reclosure operation.

The upper edge of the upper rim 15 is preferably sufficiently rounded (as shown) or chamfered so as to deflect the locking rib 26 outward around the upper rim 15 when the lid 20 is pushed downward over the container body 10 during assembly. In fact, all edges which may contact during assembly, such as the upper edge of the mouth 13 and the lower edge of the side portion 22, are preferably rounded or chamfered so as to facilitate alignment of the lid and container body during assembly. The lower rim 16, as depicted in FIG. 2, preferably extends outwardly from the container sidewall 11 far enough that the locking rib 26 is substantially hidden and substantially inaccessible once the lid 20 is assembled onto the container body 10. In a preferred embodiment, the outermost portion of lid 20 and the outermost edge of lower rim 16 are substantially flush, in order to provide a tamper-resistant quality to the container. In this fashion, since the locking rib 26 is substantially concealed and inaccessible, and since the flush nature of the peripheral portions of lower rim 16 and lid 20 does not provide any grasping portion to pry the lid free, it is virtually impossible to open the container without tearing the inner portion of the lid free at the failure zone 24.

During assembly of the lid 20 onto the container body 10, the lid 20 is forced downward over the mouth 13 of the container, with the side portion 22 being guided by the container mouth 13. The locking rib 26 is deflected outward by the outermost edge of the upper rim 15, and when the flange portion 23 contacts the flange 14 the locking rib 26 will snap into the locking groove 17, mechanically securing the lid 20 to the container body 10. The seal region 25 is them formed to provide the desired hermetic seal.

The seal region 25 is preferably of the heat seal variety (although other seal methods may be employed, as discussed below) and extends entirely around the perimeter of the lid/container body interface in the general location shown. This provides for an initial hermetic seal, and since the outermost portion of the lid remains permanently attached to the container body, this seal need not be of the peelable variety and can be designed and applied so as to achieve the desired sealing characteristics. Furthermore, since a mechanical interlocking connection is provided by the locking rib 26 and the locking groove 17, the seal need not possess any significant structural strength as it will be protected from excessive stresses by the mechanical connection.

Figure 3:
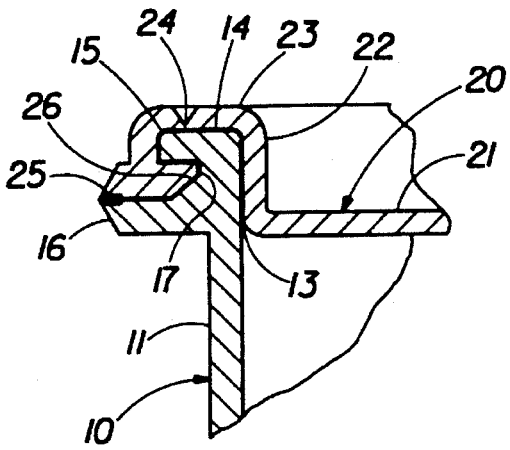
FIG. 3 is a fragmentary elevational sectional view similar to FIG. 2, but of a container design according to a second embodiment of the present invention.

FIG. 3 is a sectional view similar to FIG. 2 of a second embodiment of the present invention. The closure configuration depicted in FIG. 3 is substantially similar to that of FIG. 2, with the exception of the rearrangement of the closure elements such that the seal region 25 is now located radially outwardly of the locking elements 26 and 17. The disposition of the seal region 25 in this location may be advantageous from a manufacturing standpoint by providing an isolated region where heat may be more easily applied or concentrated for heat sealing purposes.

Figure 4:
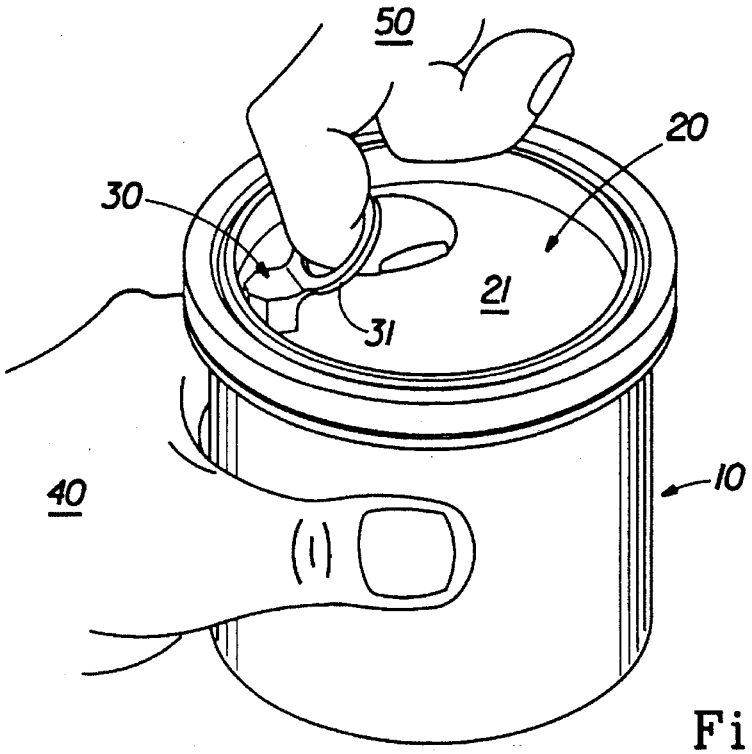
FIGS. 4 and 5 are perspective views depicting the opening process for a container design such as depicted in FIG. 3.
Figure 5:
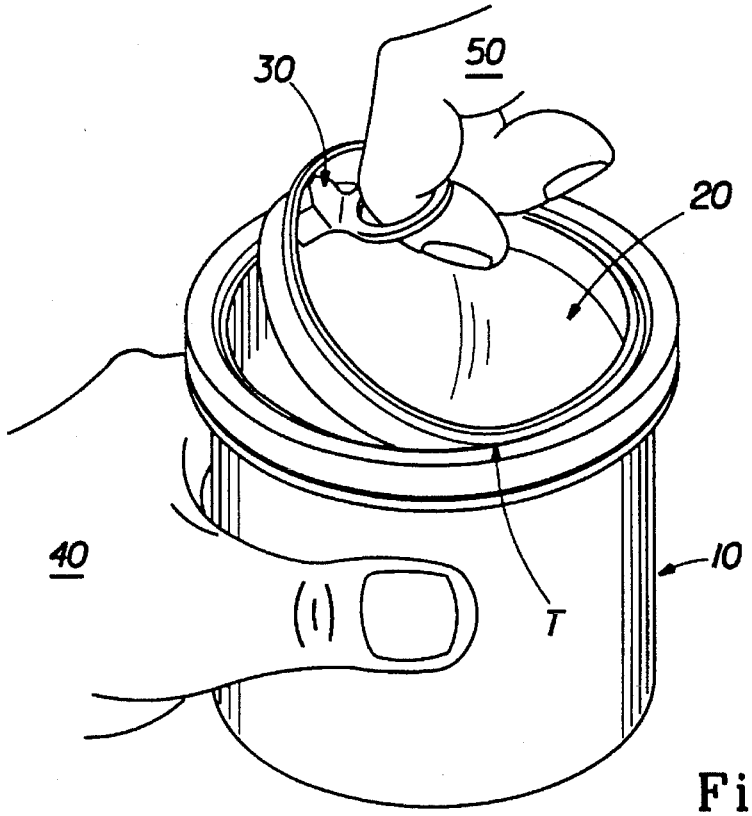

FIGS. 4 and 5 depict two stages in the initial opening process for a container having the closure configuration depicted in FIG. 3, although the closure configuration depicted in FIG. 2 would perform in substantially the same fashion.

In FIG. 4, the consumer has grasped the container body 10 with one hand 40, while one finger of the other hand 50 has been inserted into the finger loop portion 31 of the pull tab 30. While the lid 20 has not yet moved with respect to the container body 10, the free end of pull tab 30 has been elevated from its initial position overlying the center portion 21 of the lid 20.

FIG. 5 depicts the relationship of the container elements approximately halfway through the initial opening process. The consumer is pulling upward and across the container via pull tab 30 with hand 50 while restraining the container body 10 with hand 40. The lid is being divided into a central portion and a peripheral portion by the tearing action occurring at the location identified with the letter T (and at a corresponding location on the other side of the container, but hidden from view). This tearing occurs at the weakened failure zone 24 due to the concentration of the pulling force in this area of reduced cross-section. The tearing begins in the vicinity of the pull tab 30, and propagates circumferentially around the failure zone 24 in both directions until the central portion of the lid 20 is completely severed from the peripheral portion, which remains attached to the container body 10.

Once the central portion of the lid is completely removed from the container, unobstructed access to the contents of the container is obtained. If the contents of the container are not fully utilized in one use, the central portion of the lid may be reinserted into the mouth of the container to reclose and reseal the container (via the interference fit between side portion 22 and the container mouth 13) and preserve the unused portion of the product.

Figure 6:
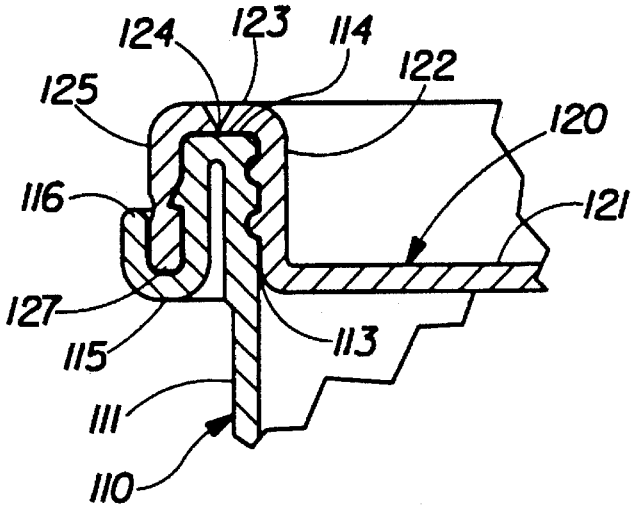
FIG. 6 is a fragmentary elevational sectional view similar to FIG. 2, but of a container design according to a third embodiment of the present invention.
Figure 7:
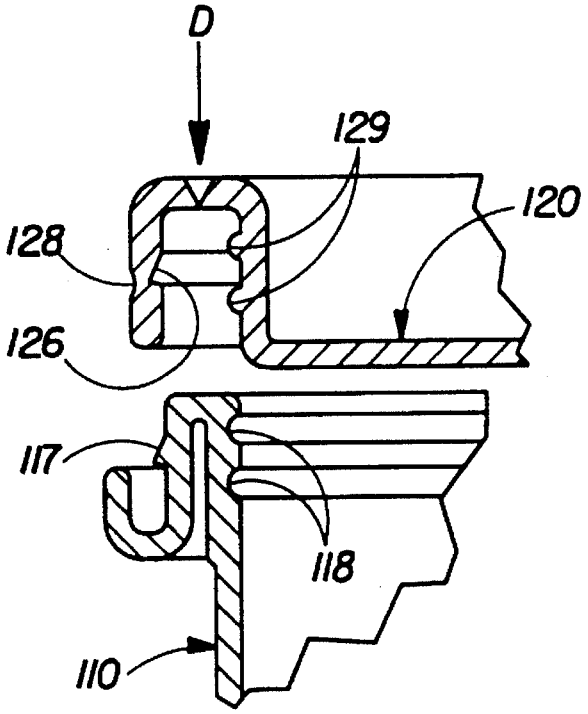
FIG. 7 is a fragmentary elevational sectional view similar to FIG. 6 illustrating the lid and container of FIG. 6 prior to assembly.

FIGS. 6 and 7 depict a container according to another embodiment of the present invention which utilizes a mechanical interlocking sealing arrangement to provide the desired hermetic seal without the need for heat sealing or bonding as in the embodiments depicted in FIGS. 1 through 5. The mechanical interlocking arrangement according to this presently preferred embodiment also provides a degree of tamper resistance, as will become apparent from the discussion which follows.

FIGS. 6 and 7 are fragmentary elevational sectional views (similar to FIGS. 2 and 3) of this mechanically sealed embodiment. The container body 110 further includes a mouth 113 having a generally annular configuration, a flange 114 which preferably has a generally planar upper surface, an outwardly projecting rim 115 which terminates in an outer lip 116, and a locking bead 117, the significance of which will be discussed below. As shown in FIGS. 6 and 7, the outwardly projecting rim preferably has a generally J-shaped cross section with the outer lip 116 at its free end, although a more U-shaped cross section could be utilized.

The lid 120 further includes a center portion 121, a peripheral flange portion 123 extending outwardly of side portion 122 and configured so as to be engageable with container flange 114, and a failure zone 124 extending circumferentially around the flange portion 123 so as to be located over the flange 114. The lid 120 also includes an outer portion (or outer depending wall) 125 extending downwardly from the flange portion 123, a locking groove 126 extending circumferentially around the inner surface of the outer portion 125 and configured so as to engage the locking bead 117 of container body 110, a lower edge 127 configured so as to be captured within the lower concave portion of the J-shaped (or U-shaped) portion of the rim 115 (below locking bead 117 and locking groove 126), and a notch 128 on the outer side of the outer portion 125 directly opposite of the locking groove 126. Notch 128 is included merely to provide for added flexibility in the outer portion 125 such that the locking groove 126 may be more easily be removed from a mold.

The central portion of the lid 120 located inward of the failure zone 124 is severable from the peripheral portion of the lid 120 located outward of the failure zone 124 in response to an upward pulling force exerted on pull tab (as previously described with respect to the embodiment shown in FIGS. 4 and 5). The central portion of the lid 120 thus formed constitutes a recloseable plug-fit closure which may be re-inserted into the mouth 113 of the container following the initial opening operation. The weakened failure zone 124 may be of any desired shape, but a generally V-shaped groove profile is presently preferred as it tends to concentrate the opening force on the smallest possible area at the bottom of the groove where the lid material is thinnest.

In a preferred configuration such as depicted in FIGS. 6 and 7, the lid 120 further includes at least one (and preferably two) retaining ribs 129 which engage corresponding retaining grooves 118 on the container body 110 in the vicinity of the annular mouth 113. These retaining ribs and grooves provide a positive engagement of the lid and container body during the reclosure operation and prevent the lid from creeping upward and out of engagement with the container mouth in the event the container is squeezed or if pressure builds up within the container during storage after the initial seal has been broken and the peripheral portion of the lid 120 no longer restrains the central portion of the lid. Such restraining beads and grooves could also be employed in the embodiments of FIGS. 1–5 in like fashion.

FIG. 7 depicts the container body 110 and lid 120 of FIG. 6 in a slightly spaced-apart arrangement prior to assembly, with the arrow D indicating the downward motion imparted to the lid 120 during the assembly operation. During assembly of the lid 120 onto the container body 110, the lid 120 is forced downward over the mouth 113 of the container, with the side portion 122 being guided by the mouth 113. The lower edge 127 follows downward along the outer surface of the outwardly projecting rim 115, passes over the preferably wedge-shaped locking bead 117, and is captured in the lowermost concave portion of the rim 115 as shown in FIG. 6. When the flange portion 123 contacts the flange 114, the locking bead 117 will snap into the locking groove 126, mechanically securing the lid 120 onto the container body 110. At this time, the restraining beads and grooves also engage one another, providing additional mechanical strength and sealing ability to the connection.

Because the contacting portions of the lid 120 and the container body 110 are preferably dimensioned so as to provide an interference fit throughout their contact area, a hermetic seal is provided both in the initial assemblage of the container components and in the reclosure scenario after initial opening of the container. The flange portion 123 inward of failure zone 124 is preferably of sufficient size so as to prevent the entire lid inward of the failure zone 124 from being pushed downward within the container body 110 during the reclosure operation.

As with the embodiments of FIGS. 1–5, all edges which may contact during assembly, such as the upper edge of the mouth 113 and the lower edge of the side portion 122, are preferably rounded or chamfered so as to facilitate alignment of the lid and container body during assembly. In addition, in order to provide a tamper-resistant quality to the container, the outer lip 116 preferably extends sufficiently far upward from the lower edge 127 that the captured portion of the outer portion 125 is substantially concealed and inaccessible. Since without access to the lower edge 127 it is very difficult to remove the locking bead 117 from the locking groove 126, it is virtually impossible to open the container without tearing the inner portion of the lid free at the failure zone 124.

A wide variety of materials may be utilized to form the container body and lid, including polyethylene (PE), polypropylene (PP), polystyrene (PS), as well as other plastics, glass, metal, rubber, or composites. Material selection may be influenced by the type of product to be placed within the container and the type of sealing technology to be employed. For example, with heat sealing some materials only bond to each other and not to dissimilar materials, while some materials are difficult to bond even with adhesives. With products such as ready-to-use frosting, high density polyethylene (HDPE) is a presently preferred material which has been found to perform satisfactorily as a lid material and as a container body material with either heat sealing technology or the mechanical sealing technology.

A variety of processes may be utilized to form the container components (container body and lid), depending once again upon the materials utilized for these components. Such processes include injection molding, thermoforming, and vacuum forming (particularly with plastic materials), although any commercially suitable process may be utilized for the selected materials. For lids and container bodies formed of HDPE, injection molding has been found to perform satisfactorily and is a presently preferred method of manufacturing these components.

The pull tabs such as depicted in the Drawing Figures are preferably unitarily molded as part of the lid when such lids are injection molded of a plastic material such as HDPE. Alternatively, the pull tabs could be separately molded or formed and secured to the lid by an adhesive or mechanical securement method. The pull tabs may have any desired shape consistent with their function in the tearing open of the container lid, such as a T-shaped handle, a solid flap, or a ring-like shape, of which the ring-like shape depicted in the Drawing Figures is presently preferred.

As shown in the Drawing Figures, the pull tabs preferably are positioned with the free grasping portion oriented toward the central portion of the lid and the solid attached portion abutting the side portion of the lid. This assists in the concentration of the pulling force on the region of the lid nearest the weakened failure zone, and the forming of the attached portion of the pull tab into a wedge shape as shown in a preferred configuration further concentrates the pulling force on a small segment of the weakened zone for enhanced tearing performance.

Although the pull tab may be secured to the lid at only one end as shown, the free end of the pull tab may be secured in some fashion to the main central portion of the lid so as to provide an additional means of achieving tamper evidency, in that the securement would be ruptured during any attempt to remove the lid via a force exerted on the pull tab. This securement could take many forms, including a spot-type heat seal, a spot-type bond with some sort of adhesive, or the like.

As mentioned previously, the seals depicted with respect to the embodiments of FIGS. 1–5 may be formed in a variety of ways, including heat sealing (wherein the two surfaces to be joined are melted slightly by heating and in effect become one), adhesive bonding (wherein the two surfaces are joined by a third component), and solvent welding (wherein a solvent is utilized to "melt" at least one of the components until it solidifies as part of the other). Each of these methods also includes a number of possible variants, such as heat sealing (ultrasonic bonding, spin welding, heated anvil, induction, etc. ) and adhesives (hot melt, resins, epoxies, contact cements, crynoacrylates, etc.).

The choice of sealing methods is to a large extent dictated by the materials selected for the lid and container. For example, few if any adhesives will bond polyethylene to polyethylene, induction heat sealing is possible only if conductive materials such as metal particles are included in the materials. With the presently preferred material (HDPE) for the lid and container body, heat sealing with a heated anvil is the presently preferred sealing method.

The containers may be of any desired size and/or overall shape, and may have mouth portions which are round, oval, rectangular, square, etc., with a lid formed in a corresponding shape. For the frosting product of particular interest, a container having a generally cylindrical configuration (with a generally circular mouth portion) sized to contain 16 ounces (0.45 kg) of product has been successfully utilized. If a container of a square or rectangular overall shape were utilized, it is believed that it would be advantageous to locate the pull tab such that it would be oriented with the attached portion disposed in one of the corners of the lid, so as to maximize the pulling force exerted upon the weakened area to initiate tearing.

The container designs herein described are believed to be suitable for use with a wide range of products, particularly of the perishable variety. Such products include, but are not limited to, food products such as ice cream, yogurt, shortening, butter, honey, ready-to-use frosting, and dry goods such as cereals and snacks, construction materials such as wood putty, spackling compound, adhesives, and paints, and many others. The specifics of the container design, seal design, and materials may of course be tailored to suit a particular product and consumer application.

While specific bead, rib, and groove arrangements have been illustrated in the Drawing Figures, it may be desirable to vary the position of such cooperating features slightly and/or to have greater or lesser numbers of such devices depending upon such factors as the materials utilized, the sealing characteristics, the dimensions of the containers, etc.

While particular embodiments of the present invention have been illustrated and described, it would be obvious to those skilled in the art that various changes and modifications can be made without departing from the spirit and scope of the present invention. For example, the products employed and the materials, sizes, and/or shapes of the overall containers may be tailored to suit a particular application. It is intended to cover in the appended claims all such modifications that are within the scope of this invention.

What is claimed is:

1. A two piece frangible opening resealable container, said container comprising:

(a) a container body with a bottom wall and a sidewall surrounding and extending upward from said bottom wall, said sidewall having an upper annular surface forming an open mouth, said sidewall also having an outwardly projecting rim forming a locking region spaced outwardly of said sidewall;

(b) a lid for sealing said mouth of said container body, said lid having a cover with an integral pull tab, said pull tab enabling said cover to be pulled upward by a user, said cover having an inner wall which forms the periphery of said cover and said inner wall frictionally contacts said mouth of the container body enabling reclosure of the container after frangible opening, said inner wall having a top annular wall extending outwardly therefrom, said top annular wall having a circumferential failure line located thereon enabling said cover to be frangibly separated from said lid, said lid further having an outer depending wall located outwardly of said failure line and extending downwardly from said top annular wall, said outer depending wall cooperates with the outwardly projecting rim of said container body forming a snap fit engagement, said outer depending wall is further engaged and captured on three sides by said outwardly projecting rim to prevent disengagement of said outer depending wall and retaining said outer depending wall after said container is frangibly opened.

2. The container according to claim 1 wherein said inner wall further comprises a circumferential retaining rib and said mouth further comprises a circumferential retaining groove which cooperate to releasably secure the cover to the container body.

3. The container according to claim 1, wherein said outer depending wall further comprises a circumferential locking groove and said outwardly projecting rim further comprises a circumferential locking bead which cooperate to affix said lid to said container body.

4. The container according to claim 1, wherein said outwardly projecting rim has a substantially J-shaped cross section.

5. The improved container of claim 1, wherein said integral pull tab is unitarily formed with said lid.

6. The improved container of claim 1, wherein said integral pull tab further comprises a generally circular loop portion to facilitate grasping by a consumer.

7. The improved container of claim 1, wherein said lid and said container body are formed of polyethylene.

8. The improved container of claim 1, wherein said failure line comprises an annular groove having a generally V-shaped cross section.

9. The improved container of claim 1, wherein said container body has a generally cylindrical overall shape.

10. An improved container for preserving a perishable product, said container comprising a container body having a bottom and an annular sidewall extending upwardly from said bottom to an upper edge, an annular mouth formed by said upper edge of said annular sidewall, said annular mouth having an inner surface, and a flange extending outwardly of said annular mouth, said container further comprising a removable lid sized to engage said inner surface of said annular mouth for closing said container, said removable lid further including an integral pull tab, the improvement comprising:

(a) said removable lid comprising a peripheral flange portion engaging said flange and extending radially outwardly over said flange, said flange portion including a weakened zone extending circumferentially around the periphery of said flange portion over said flange, said weakened zone providing a means for severing a central portion of said removable lid from said flange portion;

(b) said flange and said flange portion being mechanically interlocked circumferentially around the periphery of said container by a locking region at a location spaced radially outwardly of said weakened zone, wherein said locking region permits initial insertion of said removable lid into said annular mouth, and wherein said locking region prevents subsequent removal of said removable lid without rupture of said weakened zone;

(c) said locking region spaced radially outwardly of said annular sidewall including an outer portion extending downwardly from and circumferentially around said flange portion, said locking region further including an outwardly projecting rim which extends radially outwardly from said flange to a location beyond an outermost portion of said flange portion, said outwardly projecting rim and said outer portion cooperate to form a snap fit engagement, said outwardly projecting rim engaging and capturing said outer portion on three sides so as to prevent disengagement of said outer portion from said outwardly projecting rim as said container is frangibly opened; and (d) said removable lid further including a side portion forming a periphery of said central portion inward of said weakened zone, said side portion frictionally contacting said inner surface of said annular mouth;

whereby said weakened zone is rupturable in response to an upward force exerted upon said integral pull tab such that said central portion of said removable lid is removable for access to said product, and whereby said removable lid may be reinserted within said annular mouth of said container body to effect reclosing of said container.

11. The improved container of claim 10, wherein said removeable lid further includes at least one retaining rib and said annular mouth further includes at least one retaining groove disposed so as to engage said at least one retaining rib when said removeable lid is inserted into said annular mouth.

12. The improved container of claim 10, wherein said integral pull tab is unitarily formed with said removeable lid.

13. The improved container of claim 10, wherein said integral pull tab further comprises a generally circular loop portion to facilitate grasping by a consumer.

14. The improved container of claim 10, wherein said removeable lid and said container body are formed of polyethylene.

15. The improved container of claim 10, wherein said weakened zone comprises an annular groove having a generally V-shaped cross section.

16. The improved container of claim 10, wherein said container body has a generally cylindrical overall shape.

17. The improved container of claim 10, wherein said outer portion further includes at least one locking groove and said outwardly projecting rim includes at least one locking bead disposed so as to engage said at least one locking groove when said removeable lid is inserted into said annular mouth.

18. The improved container of claim 17, wherein said outer rim has a substantially J-shaped cross section.

* * * * *

UNITED STATES PATENT AND TRADEMARK OFFICE

CERTIFICATE OF CORRECTION

PATENT NO. : 5,511,680

DATED : April 30, 1996

INVENTOR(S) : DANIEL J. KINNE

It is certified that error appears in the above-identified patent and that said Letters Patent is hereby corrected as shown below:

Column 2, lines 52-53, "spoil age" should read -- spoilage --.

Signed and Sealed this

Ninth Day of September, 1997

*Attest:*

*Attesting Officer*

BRUCE LEHMAN

*Commissioner of Patents and Trademarks*